United States Patent [19]

Kikuchi et al.

[11] Patent Number: 4,688,980

[45] Date of Patent: Aug. 25, 1987

[54] DEVICE FOR FEEDING SPINNING BOBBINS

[75] Inventors: Shuichi Kikuchi; Hiroo Otoshima, both of Shiga, Japan

[73] Assignee: Murata Kikai Kabushiki Kaisha, Japan

[21] Appl. No.: 821,595

[22] Filed: Jan. 23, 1986

[30] Foreign Application Priority Data

Jan. 25, 1985 [JP] Japan ..... 60-13108

[51] Int. Cl.[4] ..... B65G 65/23

[52] U.S. Cl. ..... 414/414; 198/403; 414/420; 414/421

[58] Field of Search ..... 414/411, 414, 419–421, 414/425; 198/403

[56] References Cited

U.S. PATENT DOCUMENTS

| | | | |
|---|---|---|---|
| 2,577,091 | 12/1951 | Porter | 414/414 |
| 3,298,549 | 1/1967 | Schmermund | 414/414 |
| 3,861,298 | 1/1975 | Melas | 414/411 X |
| 3,915,310 | 10/1975 | Wood | 414/421 X |
| 4,269,559 | 5/1981 | Focke | 414/414 |
| 4,370,087 | 1/1983 | Shepard | 414/421 |
| 4,575,301 | 3/1986 | Lodi et al. | 414/420 X |

*Primary Examiner*—Robert J. Spar
*Assistant Examiner*—David A. Bucci
*Attorney, Agent, or Firm*—Barnes, Kisselle, Raisch, Choate, Whittemore & Hulbert

[57] ABSTRACT

A device for feeding spinning bobbins after spinning to a winder comprises a base supporting a bobbin box thereon, a cover member integrally pivoted about a shaft and being positioned in an opening of the bobbin box to prevent a bobbin from falling when the box is inverted, and a driving mechanism for turning the base and the cover member with the bobbin box upside down to transfer the bobbin box onto a bobbin conveyor, and for moving the cover member to a position at least lower than the bobbin carrying surface of the conveyor.

8 Claims, 9 Drawing Figures

DEVICE FOR FEEDING SPINNING BOBBINS

FIELD OF THE INVENTION AND RELATED ART STATEMENT

The present invention relates to a device for feeding spinning bobbins after spinning to a winder in the following step.

According to a conventional device for feeding spinning bobbins after spinning (hereinafter referred to simply as bobbins) to a winder, the bobbins are loaded in good order into a bobbin box, then the bobbin box is conveyed to the winder by a worker or by a carriage car and then it is inverted by the worker onto a lattice conveyor which transfers the bobbins to a yarn end finding device on the winder side.

In such conventional device, not only is the bobbin box heavy and the operations involve a risk, but also the surface of the bobbin yarn layer may be damaged by a shock induced when bobbins are transferred onto the conveyor. In view of these points, an automatic transfer device, especially a device capable of effecting an automatic transfer and at the same time avoiding such shock of bobbins, has been demanded.

OBJECT AND SUMMARY OF THE INVENTION

It is an object of the present invention to propose an automatic transfer device for inverting a bobbin box containing spinning bobbins and for transferring bobbins onto a conveyor without shock onto the conveyor.

The present invention is a bobbin feeder having means for supporting a first base and a cover member integrally pivotably about a shaft, the first base supporting thereon a bobbin box loaded with bobbins, the cover member being positioned in an opening of the bobbin box to prevent the bobbins from falling when the bobbin box is inverted; and means for turning the bobbin box upside down, transferring it onto a bobbin conveyor and then moving the cover member alone to a position at least lower than the bobbin carrying surface of the conveyor.

DETAILED DESCRIPTION OF PREFERRED EMBODIMENTS

Embodiments of the present invention will be described hereinunder with reference to the drawings.

Figure 1:
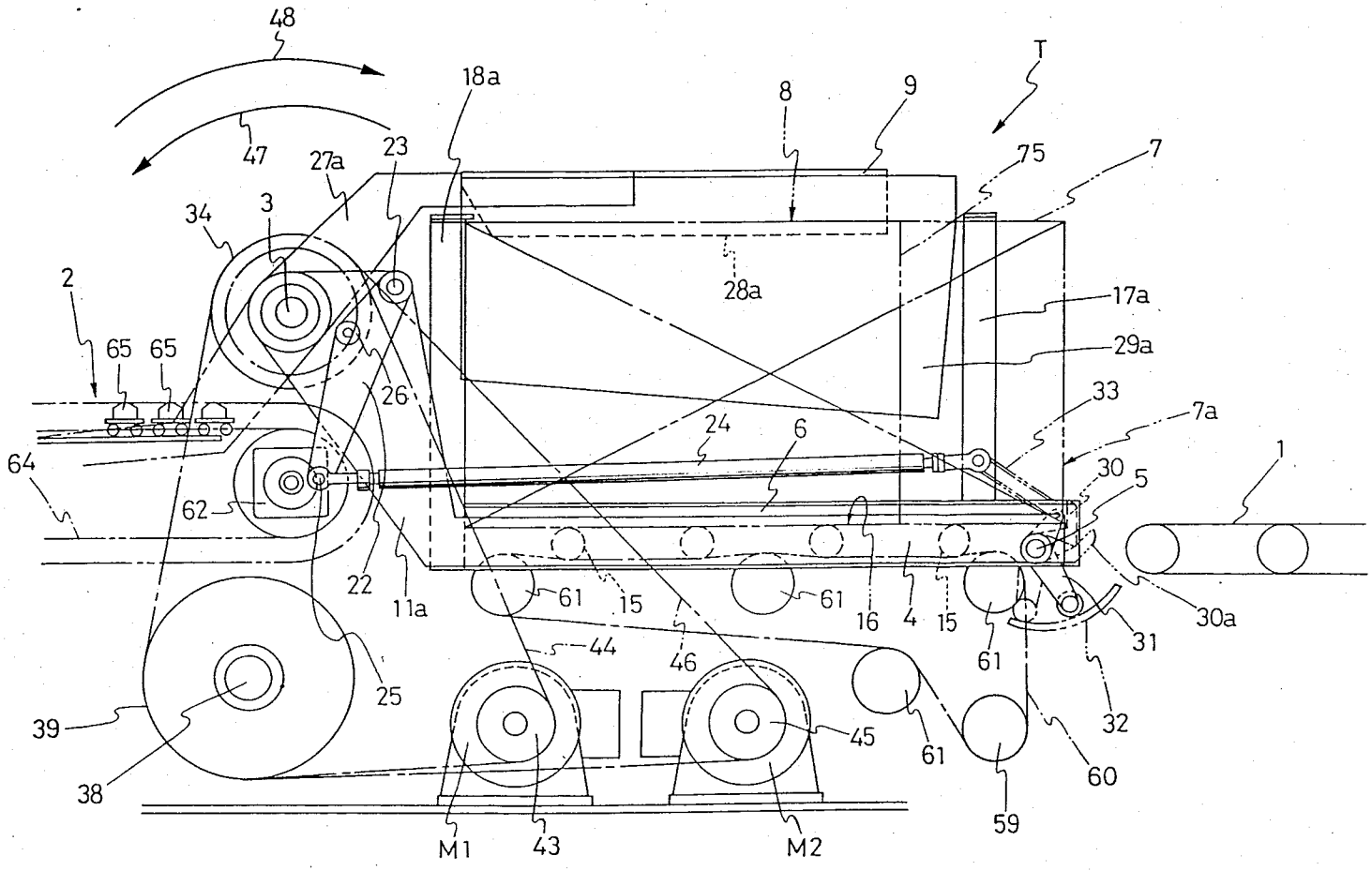
FIG. 1 is a schematic front view showing a device construction according to an embodiment of the present invention.
Figure 2:
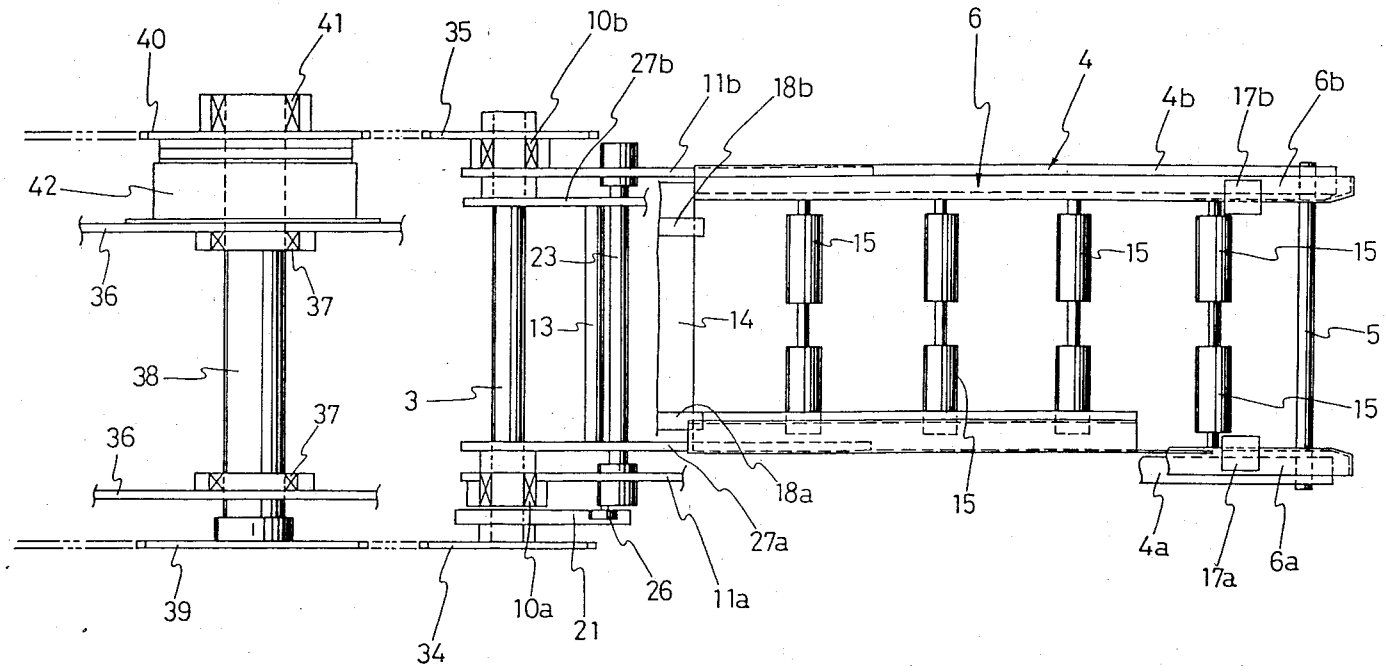
FIG. 2 is a partially omitted plan view thereof.
Figure 3:
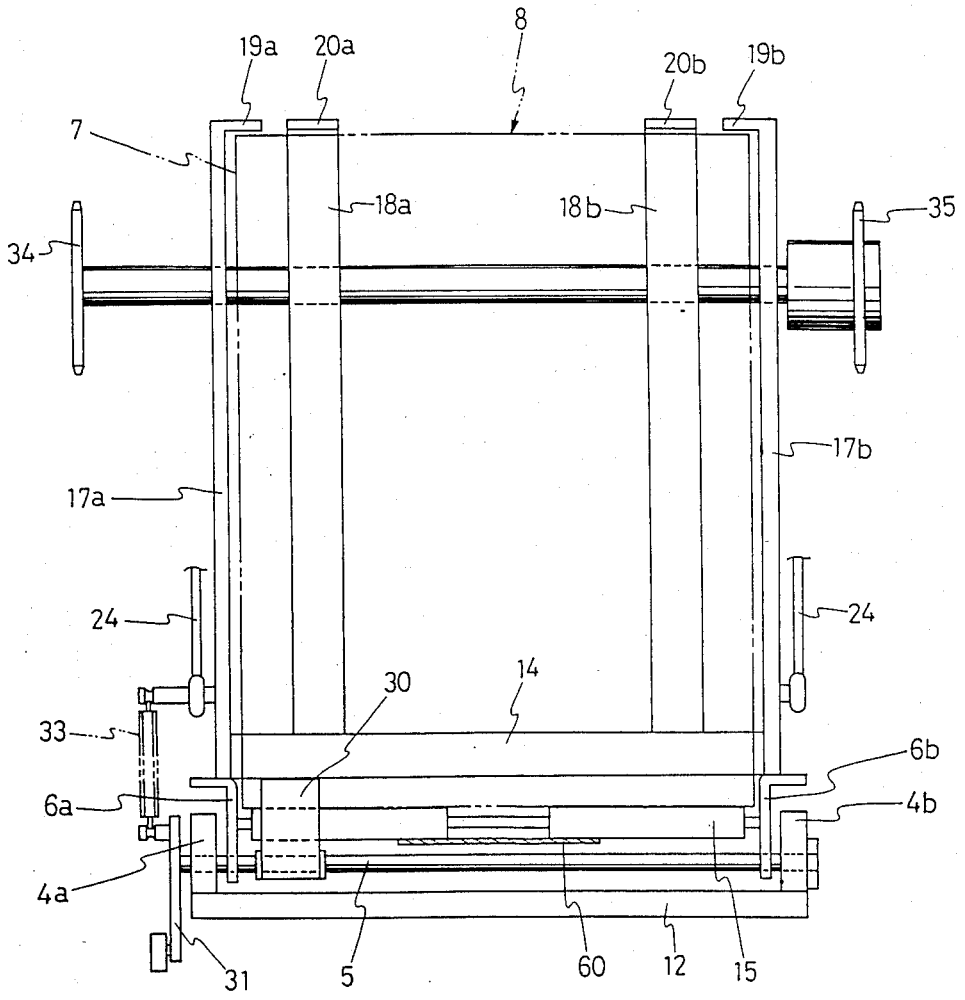
FIG. 3 is a right side view of FIG. 1.

In FIGS. 1 to 3, a bobbin feeder T is disposed serially between a bobbin box stock conveyor 1 and a winder-side lattice conveyor 2. The bobbin feeder T comprises a first base 4 which is pivotable about a shaft 3, a second base 6 mounted on the first base 4 pivotably about a first base shaft 5, and a cover member 9 positioned in an upper opening 8 of a bobbin box 7 to prevent bobbins from falling when the bobbin box is inverted, the cover member 9 being supported pivotably about the shaft 3.

The first base 4 is constituted as a framework by frames 4*a* and 4*b* and a transverse frame 14 and shafts 5, 13 extending between those frames, the frames 4*a* and 4*b* being integrally fixed to arms 11*a* and 11*b* which are supported by the shaft 3 rotatably through bearings 10*a* and 10*b*.

The second base 6 mounted on the first base 4 is constituted as a framework by side frames 6*a* and 6*b* which are pivotably cantilevered by the shaft 5 at an end portion of the first base 4, a transverse frame 14 and the shaft 5 extending through the frames 6*a*, 6*b* and also through the first base frames 4*a*, 4*b*. Bobbin box carrying rollers 15 are supported by shafts in plural positions between the frames 6*a* and 6*b* of the second base 6 to form a box carrying surface 16. Further, box receiving members 19*a*, 19*b*, 20*a* and 20*b* for receiving the bobbin box 7 upon inversion thereof are formed respectively at upper ends of support posts 17*a* and 17*b* erected on the frames 6*a* and 6*b* and upper ends of support posts 18*a* and 18*b* erected on the transverse frame 14.

Therefore, the distance between the frames 6*a* and 6*b* of the second base 6 is almost equal to the width of the box 7 and the distance between the roller 15 and the receiving member 19*a* is almost equal to the height of the box.

A relative movement between the first and second bases 4 and 6 is effected by a cam plate 21 shown in FIG. 2. More specifically, in FIGS. 1 and 2, a cam lever 22 is fixed to an end of a shaft 23 which is connected to the arm 11*a* of the first base 4, and an end portion of a rod 24 connected to a part of the second base 6 is supported at the other end of the cam lever 22 by a shaft 25. Further, a cam follower 26 is supported by a shaft in an intermediate position of the cam lever 22. Therefore, as the cam follower 26 is displaced about the shaft 23 by the cam plate 21, the rod 24 moves right and left in FIG. 1 through the cam lever 22, so that the second base 6 pivots about the shaft 5 of the first base 4 in a certain angular range. Control is made so that the pivoting motion of the second base 6 relative to the first base 4 is effected only when an empty box after feed of the inside bobbins onto the lattice conveyor is discharged onto an empty bobbin discharge conveyor disposed above the stock conveyor.

Figure 8:
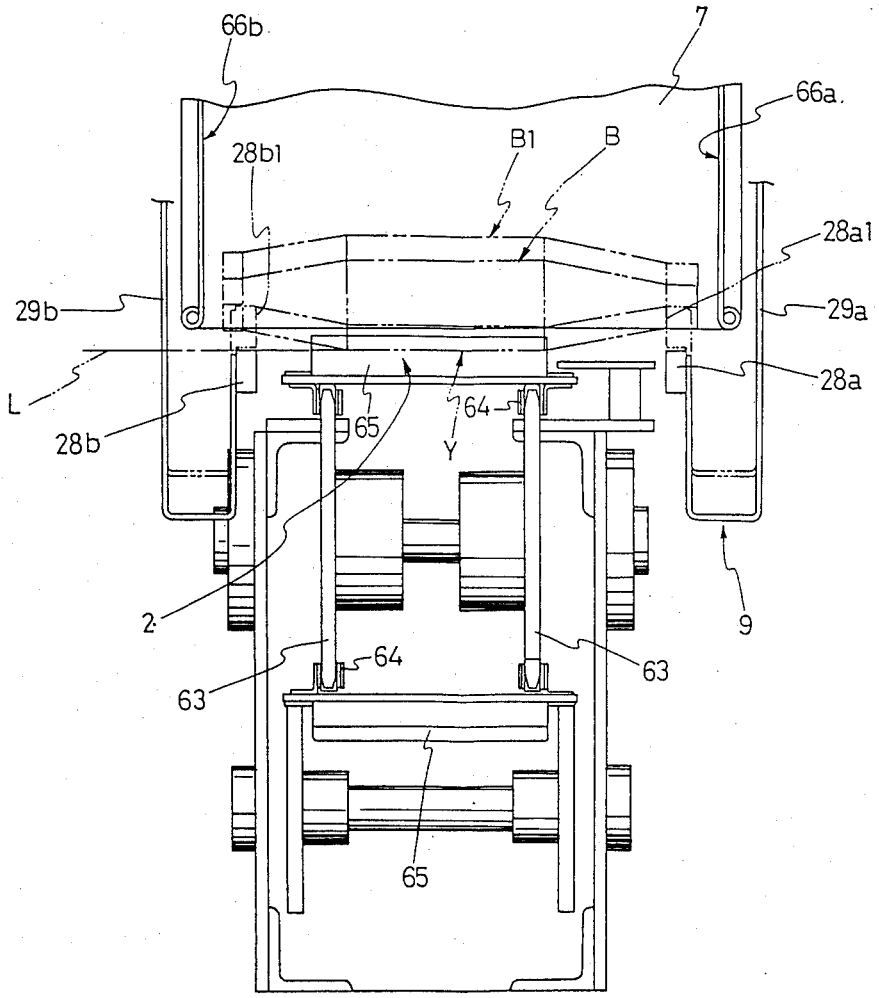
FIG. 8 is a side view showing in what state a cover member is when bobbins are transferred onto a lattice conveyor.

The cover member 9 of the bobbin box 7 is composed of bobbin receivers 28*a* and 28*b* which are integral with arms 27*a* and 27*b* fixed to the shaft 3 and which support both end portions of each bobbin, and guide plates 29*a* and 29*b* for guiding both end portions of each bobbin when the bobbin box is inverted to feed bobbins onto the lattice conveyor 2. As shown in FIG. 8, the receiving members 28*a* and 28*b* which support both end portions of each bobbin B and the guide plates 29*a* and 29*b* which prevent an axial movement and falling of each bobbin are formed integrally. The distance between the bobbin receiving members 28*a* and 28*b* is set larger than the width of the lattice conveyor 2 so that after the box is inverted to transfer the bobbins onto the lattice conveyor 2 the receiving members 28*a* and 28*b* can move to positions lower than a bobbin carrying surface L of the same conveyor.

In FIGS. 1 and 3, a stopper 30 which abuts an end face 7*a* of the box 7 is fixed to the shaft 5, and a cam lever 31 is fixed to an end portion of the shaft 5, the cam lever 31 being operated by a cam plate 32 to open and close the stopper 30. In the box receiving position in FIG. 1 the stopper 30 is pivotally moved to a dash-double dot line position 30*a* against the force of a spring 33 by means of the cam plate 32 which is fixed on the ground side, to receive the bobbin box on the conveyor 1, while when the cam lever 31 moves away from the cam plate 32 during inversion, the stopper 30 reverts to its original position to prevent the box 7 from falling.

Drive means for the first base 4 and the cover member 9 will now be described. In FIGS. 1 and 2, sprockets 34 and 35 are mounted on both end portions of the shaft 3. One sprocket 34, which is fixed to the shaft 3, is for pivotal motion of the arms 27*a* and 27*b* of the cover member 9, while the other sprocket 35 is supported for free rotation about the shaft 3 through a bearing 10*b* and it is for pivotal motion of the arms 11*a* and 11*b* of the first base 4. The sprocket 35 and the first base arm 11*b* are integrally constructed.

Further, sprockets 39 and 40 are supported at both ends of an intermediate shaft 38 which is supported between stationary frames 36 through bearings 37. The sprocket 39, which is for the cover member, is fixed to the intermediate shaft 38, while the sprocket 40, which is for the first base, is supported for free rotation about the intermediate shaft 38 through a bearing 41. A clutch 42 is mounted on the shaft 38 and it is controlled to transmit or cut off the rotation of the intermediate shaft 38 with respect to the sprocket 40. As shown in FIG. 1, moreover, a chain 44 is wound over a sprocket 43 wnich is fixed to an output shaft of a cover member rotating motor M1, the sprocket 39 on the intermediate shaft and the sprocket 34 on the side of the shaft 3. Also, a chain 46 is wound over a sprocket 45 of a first base rotating motor M2, the intermediate sprocket 40 and the sprocket 35 on the shaft 3.

When the box 7 loaded with bobbins is to be turned toward an arrow 47 from its state shown in FIG. 1, the clutch 42 is turned on to allow only the motor M1 to be driven, so that the sprockets 34 and 35 on both ends of the shaft 3 rotate synchronously, whereby the first and second bases 4 and 6 and the cover member 9 can be pivoted integrally.

On the other hand, after inversion of the bobbin box onto the lattice conveyor 2 and completion of the feed of bobbins, the first base 4 and the cover member 9 are driven each independently. More specifically, first only the first base 4 is rotated by the motor M2, and upon completion of bobbin transfer from the lattice conveyor after discharge of the empty bobbin box onto the discharge conveyor, only the cover member 9 is turned toward an arrow 48 by operation of the motor M1. While the first base 4 and the cover member 9 turn toward the arrow 48, the clutch 42 is kept off.

Figure 4:
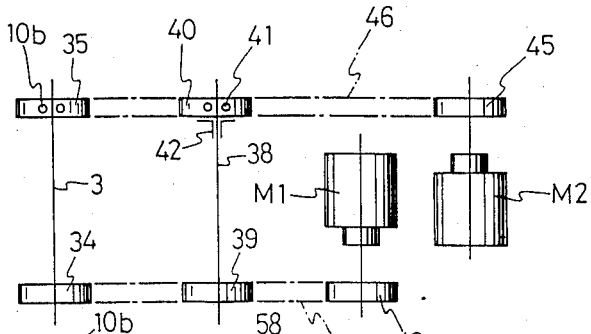
FIG. 4 is a schematic view showing an example of a drive unit.

It is FIG. 4 that illustrates the above drive means schematically, in which two motors M1, M2 and a single clutch 42 are used.

Figure 5:
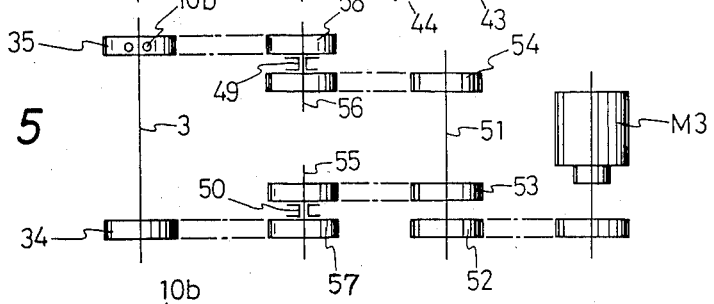
FIG. 5, is a schematic view showing another example thereof.

FIG. 5 illustrates another embodiment in which a single motor M3 and two clutches 49 and 50 are used. Driving force of the motor M3 is transmitted from an input sprocket 52, which is fixed to a first intermediate shaft 51, to coaxially fixed output sprockets 53 and 54 and then to input sprockets 57 and 58 on second divided intermediate shafts 55 and 56. Rotation of the first base sprocket 35 and that of the cover member sprocket 34 are controlled in accordance with on-off of the clutches 49 and 50. It is shown in the figure that the sprocket 35 is supported on the shaft 3 through the bearing 10*b*. Therefore, when the first base, etc. are turned toward the arrow 47 in FIG. 1, the clutches 49 and 50 are both turned on, allowing the sprockets 34 and 35 to rotate synchronously. On tne other hand, when the first base and the cover member are to be turned toward the arrow 48, if the clutch 50 is turned off and only the clutch 49 turned on, then only the first base sprocket 35 will rotate, and if the clutch 49 is turned off and only the clutch 50 turned on, then only the cover member sprocket 34 will rotate.

Figure 6:
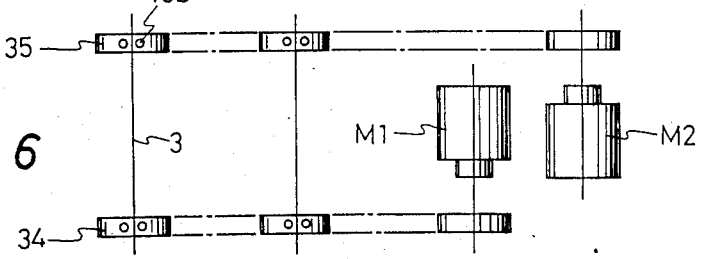
FIG. 6 is a schematic view showing a further example thereof.

FIG. 6 illustrates a further embodiment in which a first base rotating motor M2 and a cover member rotating motor M1 are mounted separately and both motors are rotated synchronously during simultaneous rotation, thereby omitting the use of a clutch.

The operation of the above device will be explained below.

Figure 7:
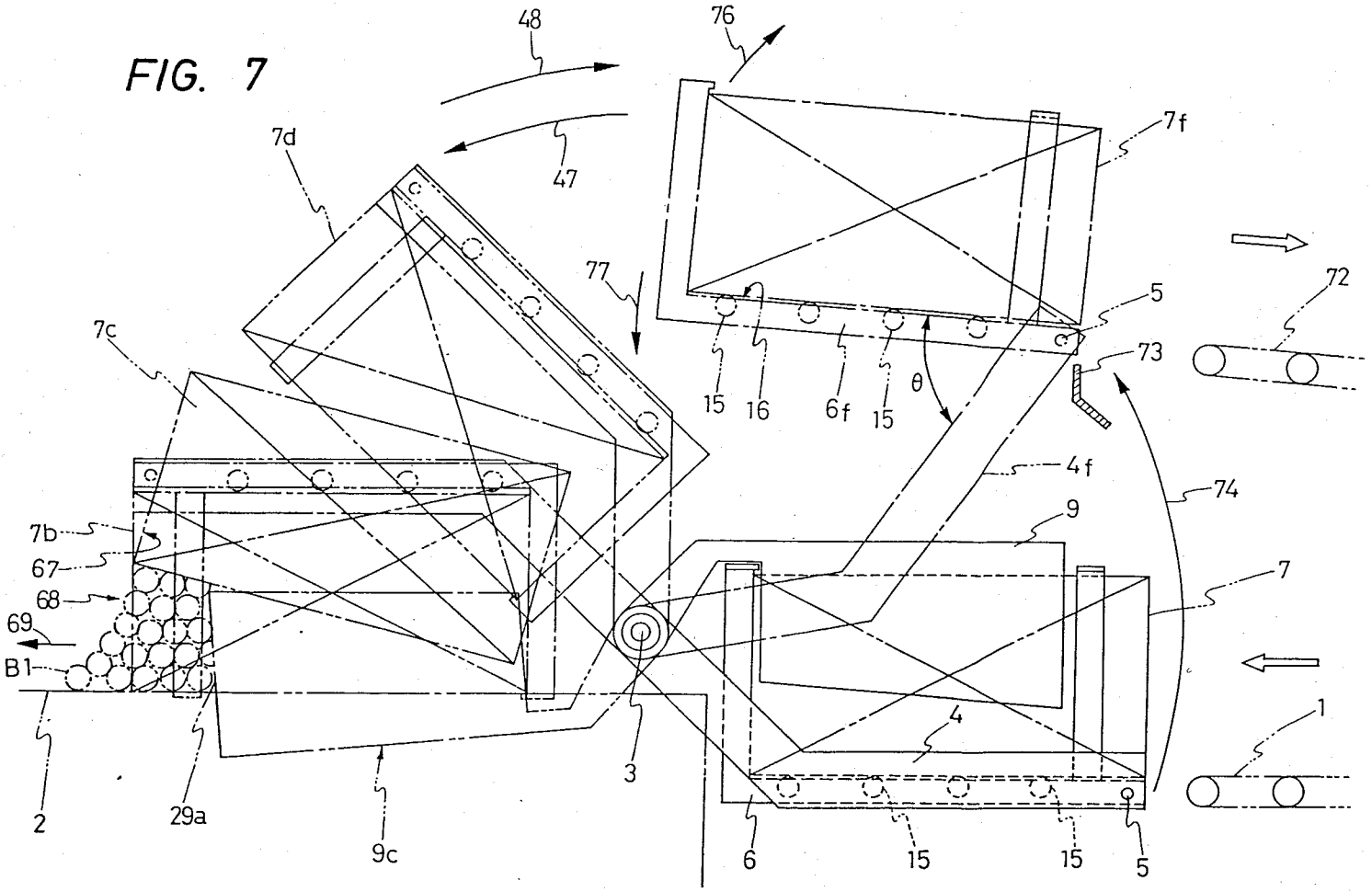
FIG. 7 is a front view showing operations of the above device.

In FIG. 7, the first base 4 and the second base 6 are brought into their box receiving positions as indicated by solid lines. In this state, the cover member 9 is in a dash-double dot line position 9*c* on the side of the lattice conveyor 2 which is an approximately 180°-turned position. In this positional relation, the bobbin box 7 full of bobbins is transferred from the stock conveyor 1 onto the rollers 15 of the second base 6. In this case, a fixed piece (not shown) provided on the first base side releases the stopper on the stock conveyor side at the time of return of the first and second bases 4 and 6 to their box receiving positions, whereby only the head box on the stock conveyor 1 which is somewhat inclined is allowed to advance onto the rollers 15. Since the rollers 15 of the second base 6 are in pressure contact with a belt 60 which is rotated by a motor 59 shown in FIG. 1, the rollers 15 are rotated, thereby ensuring the transfer of the box to a predetermined position. Numeral 61 denotes a guide roller for the belt 60.

In this loaded state of the box 7 on the second base 6 in FIG. 7, all the bobbins present between the guide plates 29*a* and 29*b* are fed to the winder side, whereupon the cover member rotating motor M1 is driven to pivot the arms 27*a* and 27*b* reversely, thereby allowing the cover member 9*c* to return to its solid line position in FIG. 7. As soon as the return is detected by a sensor (not shown), the motor M1 and the clutch 42 in FIG. 4 are turned on and the sprockets 34 and 35 on the shaft 3 rotate synchronously, so that the box 7 is turned toward the arrow 47 in FIG. 7, thus inverted, and stops in a bobbin carrying position 7*b* on the lattice conveyor 2. In this position, bottom bobbins are in a position B1, in which position the bobbins are in a supported state on cover members 28al and 28bl at both end portions thereof and not placed yet on the lattice conveyor 2. Subsequently, as the cover member 9 alone moves slowly until it is positioned below the bobbin carrying surface L of the lattice conveyor 2, a yarn layer portion Y is transferred softly onto the conveyor 2. As shown in FIGS. 1 and 8, the lattice conveyor 2 comprises chains 64 entrained about sprockets 63 which are rotated by a motor 62 and chevron-like transfer members 65 connected to the chains 64. Bobbins are conveyed one by one while being each supported between the chevrons 65.

The cover member 9 moves to its dash-double dot line position 9c in FIG. 7 and the first and second bases 4 and 6 integrally turn reversely in the direction of arrow 48 until the box moves to its dash-double dot position 7c, whereby the bobbins B in the box 7c are transferred onto the lattice conveyor 2 smoothly from an opening portion 68 while their stack collapses and while being restricted by inner side faces (66a and 66b in FIG. 8) of the box 7c and an end face (67 in FIG. 7) of the box, and are conveyed with movement of the lattice conveyor 2 in the direction of arrow 69 successively from the head bobbin B1.

The bobbins in the box 7c go down gradually toward the upper surface of the lattice conveyor while both end portions thereof are guided by the inner side faces (66a and 66b in FIG. 8) of the box, and when they reach a position lower than the box inner side faces 66a and 66b, deviations in the bobbin axial direction are restricted between the guide plates 29a and 29b which are integral with the cover member 9, and in this state the bobbins continue to go down. When most of the bobbins are discharged from the box and occupy positions lower than the inner side faces 66a and 66b of the box 7c and the proportion of the bobbins located in lower positions of the box decreases, that is, when the box 7c no longer serves as a guide for bobbins, a reverse turning and discharge operation for the empty box is started manually or in accordance with a signal provided from a bobbin quantity sensor.

If only the motor M2 for the first base shown in FIG. 4 is reverse-rotated and the clutch of 42 of the shaft 38 is turned off, the first and second bases 4 and 6 turn in the direction of arrow 48 beyond an intermediate position 7d in FIG. 7 while supporting the empty box. At this time, the shaft (3 in FIG. 2) of the cover member 9c does not rotate and hence the position of the cam plate 21 fixed to an end portion of the shaft 3 is also unchanged.

Figure 9:
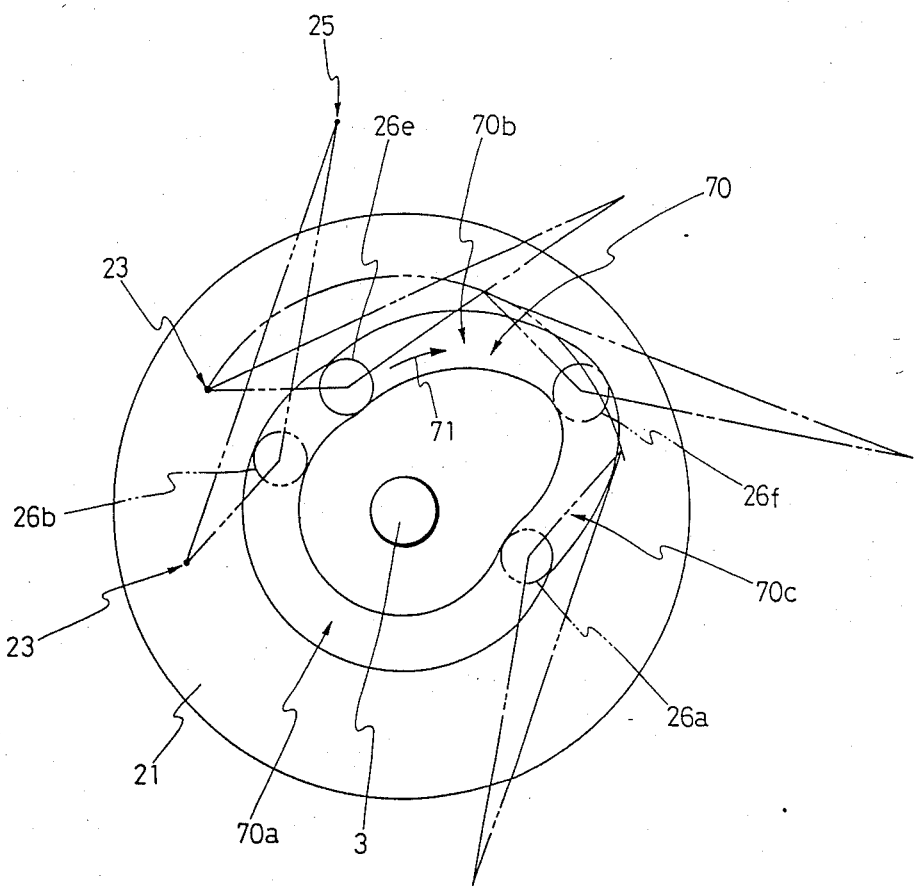
FIG. 9 is a front view showing a relation between a cam plate and a cam follower.

In this state the sprocket 35 integral with the arm 11b of the first base 4 is reverse-rotated whereby the first and second bases 4 and 6 are turned synchronously up to a certain position. In FIG. 9, during reverse turning of the empty box, the cam plate 21 on the shaft 3 is positioned as shown and the cam follower 26 of the cam lever 22 pivoted on the arm 11a of the first base 4 moves around the shaft 3 while describing a specific path and while being restricted by a cam groove 70 of the cam plate 21. If the cam follower 26 moves on a circular arc 70a of the same radius around the shaft 3, there will occur no relative motion between the first and second bases, but as the cam follower 26b moves in the direction of arrow 71 past an intermediate position 26e in FIG. 9, the distance between the cam follower 26 and the center of the shaft 3 increases gradually. Because of such a cam shape, the cam follower 26 turns in a clockwise direction around the shaft 23 in FIG. 1 with rotation of the first base 4, so that the rod 24 is pushed and displaced through the cam lever 22, thus causing the second base 6 connected to the rod 24 to turn clockwise about the shaft 5 on the first base 4. When the first base 4 reaches a dash-double dot line position 4f in FIG. 7, the second base 6 occupies a position 6f which corresponds to a turning in the direction of arrow 76 about the shaft 5 by an angle of $\theta$, and the box carrying surface 16 of the second base 6f is inclined toward an empty bobbin discharge conveyor 72.

In the above position, if the stopper (30 in FIG. 1) of the empty box 7f is turned in a clockwise direction, the box 7f will slide on the rollers 15 by virtue of its own weight until it is discharged onto the conveyor 72. As means for releasing the stopper 30 there may be used any suitable means. According to the means adopted in this embodiment, a stopper actuating piece (31 in FIG. 1) is displaced by a fixed cam member 73 to turn and release the stopper 30.

More specifically, during rotation in the direction of arrow 74, the actuating piece 31 for the stopper 30 moves along a path on the arrow 74, namely, on a circular arc of a radius centered on the shaft 3, and therefore it does not interfere with the cam member 73.

Further, with rotation of the first base 4f in the direction of arrow 48 in FIG. 7, the first base 4f returns to its original solid line position 4 and the cam follower 26f moves from its dash-double dot line position 26f in FIG. 9 along a cam groove 70c which gradually decreases its distance from the shaft 3 and reaches a dash-double dot line position 26a, whereupon the second base 6f returns to its solid line position 6 in FIG. 1 while rotating about the shaft 5 in the direction of arrow 77.

After the return to the original position of the second base 6, the next bobbin box full of bobbins which stands by on the conveyor 1 is transferred onto the second base 2, waiting for the next inverting operation.

Then, on the lattice conveyor 2 in FIG. 7, all of the bobbins positioned between the guide plates 29a and 29b are transferred onto the conveyor and discharged from within the movement path of reverse rotation of the cover member 9, whereupon a cover member rotating motor (M1 in FIG. 4) is reverse-rotated manually or in accordance with a signal provided from a bobbin sensor, thereby causing the cover member 9c and cam plate 21 to return to the original solid line position 9 in FIG. 1. At this time, the clutch 42 in FIG. 5 is off, of course, and only the sprockets 43, 39 and 34 on the side of the motor M1 rotate reversely.

Upon detection of the return to the original position of the cover member 9 by means of a cover member return detector such as a proximity sensor as previously noted, the foregoing bobbin feed operation is again started.

The bobbin box 7 shown in this embodiment is internally provided with a partition plate in a dash-double dot line position 75 in FIG. 1. Bobbins are loaded into the left-hand box portion in FIG. 1, while the right-hand box portion is in an empty state during bobbin feed. The right-hand box portion is for housing therein empty bobbins discharged from the winder and conveying them to a spinning frame.

According to the present invention, as set forth hereinabove, it is possible to automate the operation of inverting a box which contains bobbins and transferring the bobbins together onto a conveyor. In this case, the bobbins can be placed softly without shock onto the conveyor, whereby it is possible to prevent damage of the yarn layer surface.

What is claimed is:

1. A bobbin feeder comprising:

means for supporting a first base and a cover member pivoted about a first shaft, said first base supporting a bobbin box thereon, said cover member being positioned in an opening of the bobbin box to prevent a bobbin from falling when the box is inverted; and means for turning the bobbin box upside down by pivoting said first base and said cover, transferring it onto a bobbin conveyor and then moving said cover member alone to a position at least lower than the bobbin carrying surface of said conveyor.

2. The bobbin feeder as claimed in claim 1, wherein it further includes a second base mounted on said first base pivotally about a second shaft of the first base.

3. The bobbin feeder as claimed in claim 2, wherein said first base comprises a pair of frames being integrally fixed to first arms which are rotatably supported by the first shaft, a traverse frame and the second shaft so as to be constituted as a framework.

4. The bobbin feeder as claimed in claim 2, wherein said second base comprises side frames which are pivotably cantilevered by the second shaft at an end portion of the first base, another traverse frame and the second shaft extending through the side frames, bobbin box carrying rollers supported by shafts in plural positions between the side frames of the second base to form a box carrying surface, and box receiving members for receiving the bobbin box upon inversion thereof formed respectively at upper ends of first support posts erected on the side frames and upper ends of second support posts erected on the traverse frame.

5. The bobbin feeder as claimed in claim 1, wherein said means for driving the first base and the cover member integrally comprises a first sprocket and a second sprocket mounted on both end portions of the first shaft, respectively, said first sprocket fixed to the first shaft being for pivotal motion of the arms of the cover member, while said second sprocket being supported for free rotation about the first shaft and being for pivotal motion of the arms of the first base.

6. The bobbin feeder as claimed in claim 2, wherein it further includes means for a relative movement between the first and second bases comprising a cam lever fixed to an end of a third shaft which is connected to the arm of the first base, a cam follower supported pivotally in an intermediate position of the cam lever, a rod pivotally supported at the other end of the cam lever, and a cam plate fixed to the first shaft, said cam follower of the cam lever being abutted with a cam face of the cam plate so that the second base may pivot about the second shaft of the first base in a certain angular range.

7. The bobbin feeder as claimed in claim 1, wherein said cover member comprises bobbin receivers which are integral with arms which are fixed to the first shaft and which support both end portions of each bobbin and guide plates for guiding the both end portions of each bobbin when the bobbin box is inverted to feed bobbins onto the bobbin conveyor, the distance between said bobbin receivers being greater than the width of the bobbin conveyor so that after the box is inverted to transfer the bobbin onto the bobbin conveyor the receiving members can move to positions lower than a bobbin carrying surface of the conveyor.

8. The bobbin feeder as claimed in claim 2, wherein a stopper which abuts an end face of the box is fixed to the second shaft and is moved by means of a second cam lever fixed to an end portion of the second shaft and being operated by a second cam plate to open and close the stopper.

* * * * *